US009145222B2

(12) United States Patent
Michels

(10) Patent No.: US 9,145,222 B2
(45) Date of Patent: Sep. 29, 2015

(54) FOLDING METHOD AND APPARATUS FOR MAKING A CARTON

(75) Inventor: Frank Michels, Kleve (DE)

(73) Assignee: MSK-VERPACKUNGS-SYSTEM GMBH, Kleve (DE)

( * ) Notice: Subject to any disclaimer, the term of this patent is extended or adjusted under 35 U.S.C. 154(b) by 1130 days.

(21) Appl. No.: 13/087,652

(22) Filed: Apr. 15, 2011

(65) Prior Publication Data

US 2011/0256997 A1 Oct. 20, 2011

(30) Foreign Application Priority Data

Apr. 15, 2010 (EP) ..... 10003985

(51) Int. Cl.

| | |
|---|---|
| ***B31B 1/12*** | (2006.01) |
| ***B31B 1/46*** | (2006.01) |
| ***B65B 43/18*** | (2006.01) |
| ***B31B 1/00*** | (2006.01) |
| ***B65B 43/26*** | (2006.01) |
| ***B65H 3/08*** | (2006.01) |

(52) U.S. Cl.

CPC ..... *B65B 43/185* (2013.01); *B31B 1/00* (2013.01); *B65B 43/265* (2013.01); *B65H 3/0816* (2013.01); *B31B 2201/267* (2013.01); *B31B 2201/2666* (2013.01); *B31B 2203/066* (2013.01); *B31B 2203/084* (2013.01); *B65H 2406/341* (2013.01); *B65H 2406/342* (2013.01); *B65H 2701/1764* (2013.01)

(58) Field of Classification Search

CPC ..... B65B 5/02; B65B 43/26; B65B 43/28; B65B 43/185; B31B 2201/28; B31B 2219/28; B31B 2201/0211; B31B 2203/082; B31B 2201/267; B31B 2201/027; B31B 2201/922; B31B 2201/92; B65H 2406/341; B65H 3/0816; B65H 2406/342

USPC ..... 53/329; 493/63, 69, 70, 79, 80, 122, 493/123, 124, 126, 151, 167; 414/796.5, 414/796.9, 797

See application file for complete search history.

(56) References Cited

U.S. PATENT DOCUMENTS

| | | | | |
|---|---|---|---|---|
| 2,624,248 A | | 1/1953 | Baker et al. | |
| 5,120,292 A | * | 6/1992 | Ueda et al. | 493/124 |
| 5,971,906 A | * | 10/1999 | Tharpe et al. | 493/131 |

FOREIGN PATENT DOCUMENTS

| | | | |
|---|---|---|---|
| DE | 3439908 | A1 | 4/1986 |
| DE | 202004005195 | U1 | 7/2004 |
| EP | 1637323 | A1 | 3/2006 |
| WO | 99/06283 | A1 | 2/1999 |

* cited by examiner

*Primary Examiner* — Thanh Truong
*Assistant Examiner* — Xavier A Madison
(74) *Attorney, Agent, or Firm* — Andrew Wilford

(57) ABSTRACT

An apparatus for making a box from a foldable blank having a central polygonal floor panel and a plurality of outwardly projecting side panels has a frame, a supply on the frame holding the blank, a folder on the frame above the supply, and a feeder having a grab engageable with the blank in the supply and movable to a position above the folder. The feeder picks up the blank with the grab, moves the picked-up blank and grab up to above the folder, and deposits the picked-up blank in the folder that folds the deposited blank into a box.

9 Claims, 6 Drawing Sheets

FOLDING METHOD AND APPARATUS FOR MAKING A CARTON

FIELD OF THE INVENTION

The present invention relates to making a carton or box. More particularly this invention concerns a method of an apparatus for making such boxes from a stack of flat blanks.

BACKGROUND OF THE INVENTION

A box is typically made from a blank of cardboard or the like having a central polygonal floor panel from whose sides project side panels. The apparatus for making boxes from such blanks has a feeder for supplying cardboard blanks to the apparatus and a folder for folding the cardboard blanks. In top view, it is advantageous for the cardboard blank and/or a cardboard box that is to be folded to be rectangular and/or square. It is within the scope of the invention for the cardboard box that is to be folded to be upwardly open.

Cardboard folders of the type as described above are known from practice in various constructions. The known devices are typically characterized by relatively complex and/or time-consuming process steps. Many apparatuses of the type as described above have a pickup tool that picks up the cardboard blank from a stack of cardboard blanks. This pickup tool transfers the cardboard blank it has picked up from the stack to a feed tool, and the feed tool supplies the cardboard blank to the folder. The operating speeds and/or safety of these known cardboard-folding apparatuses are far from perfect. The processing is comparatively complex in these devices, plus they are susceptible to breakdowns. The cardboard-folding apparatuses that are known in practice suffer, furthermore, from the considerable disadvantage that they require a great deal of space and/or are quite voluminous in design.

OBJECTS OF THE INVENTION

It is therefore an object of the present invention to provide an improved folding method and apparatus for making a carton.

Another object is the provision of such an improved folding method and apparatus for making a carton that overcomes the above-given disadvantages, in particular that allows for high operating speeds coupled with simple, less complex and functionally reliable, error-free process handling that is characterized at the same time by its minimal space requirements.

SUMMARY OF THE INVENTION

An apparatus for making a box from a foldable blank having a central polygonal floor panel and a plurality of outwardly projecting side panels has according to the invention a frame, a supply on the frame holding the blank, a folder on the frame above the supply, and a feeder having a grab engageable with the blank in the supply and movable to a position above the folder. The feeder picks up the blank with the grab, moves the picked-up blank and grab up to above the folder, and deposits the picked-up blank in the folder that folds the deposited blank into a box.

The cardboard blank that is picked up by the feeder is supplied directly to the folder by the feeder. The term "directly" in this context means, in particular, that no further feed elements are between the pickup of the cardboard blank by the feeder and the release of the cardboard blank to the folder.

It is within the scope of the present invention that the cardboard blank and/or the cardboard box is comprised of paperboard, particularly of corrugated cardboard. It is advantageous for the floor panel and the side panels, in particular the four side panels, of the cardboard blank to be in one plane. The scope of the invention further envisions that, following the folding of the cardboard into a cardboard box, the box has a floor panel and side panels transverse and/or perpendicular thereto that are aligned substantially perpendicular to the floor panel. Preferably, the result after the folding process is a rectangular and/or square cardboard box with four side panels. It is advantageous for the cardboard box to be open upward. Cardboard boxes that are manufactured according to the invention are suited primarily for packaging products and/or goods on pallets.

Advantageously, the feeder picks up a cardboard blank from a cardboard blank loader and/or a cardboard blank stack, and the cardboard blank supply and/or cardboard blank stack is formed preferably by a plurality of cardboard blanks that are piled on top of each other. It is recommended for the folder and the cardboard blank supply and/or cardboard blank stack to be vertically, and/or to be vertically, one above the other, at least partially. It is advantageous for the cardboard blank supply and/or cardboard blank stack to be vertically, at least partially, below the folder and/or below a folding table of the folder.

It is within the scope of the invention that the feeder can be positioned in a pickup position in which the feeder picks up a cardboard blank, and that the feeder can be positionable in a transfer position in which the cardboard blank is handed over from by the feeder to the folder and/or placed on the folding table of the folder. It is advantageous for the feeder to be movable vertically from the pickup position to the transfer position; in particular, it is especially preferred if the apparatus can only be moved vertically. It is recommended for the feeder to be movable vertically with a loaded cardboard blank, which was picked up in the pickup position, from the pickup position and upward to the transfer position; and then, following the release of the cardboard blank to the folder, the feeder can be moved vertically downward from the transfer position to the pickup position, etc.

An especially preferred embodiment according to the invention is characterized by the fact that the feeder has a grab for picking up the cardboard blank and that is held inside a track guide. It is within the scope of the invention that the grab is used for picking up a cardboard blank from a cardboard blank supply and/or cardboard blank stack. Preferably, the grab releases the cardboard blank that was picked up previously to the folder when the feeder is in the transfer position. It is advantageous for the track guide with grab to be vertically movable from the pickup position to the transfer position and vice versa.

The track guide for the grab preferably has at least two tracks that are preferably parallel to each other. According to an especially preferred embodiment of the invention, the track guide has first straight and/or substantially straight track sections. The two parallel straight track sections are advantageously horizontally level with each other. It is recommended that a cardboard blank is picked up by the grab when the feed apparatus is in its pickup position and when the grab is guided and/or in the first straight track sections.

It is recommendable for the track guide to comprise second track sections that extend transversely to the first straight track sections. When the feed apparatus is moved from the pickup position to the transfer position, it is advantageous for the grab, with picked-up cardboard blank, to be positioned and/or in the second track sections. Thus, it is with this position of the grab that the feed apparatus is, as is recommended, moved from the pickup position toward the folder and into the transfer position. It is preferred to have at least two, preferably only two, second track sections that are, as is recommended, parallel to each other. The second tack sections are advantageously configured as rounded and/or arcuate, preferably in the shape of a part-circular arc. In an especially preferred embodiment of the invention the second track sections extend over a circular arc which corresponds to one third to two thirds, preferably half and/or approximately half, of the arc of the circle. It is advantageous for the second track sections to be joined directly to the first straight track sections. The track guide thus has only and/or substantially the first track sections and the second track sections.

It is advantageous for the first straight track sections of the feeder to be travel past opposite sides of the folding table of the folder when the feeder is moved and/or vertically moved from the pickup position to the transfer position and vice versa. This way it is possible for the apparatus to be especially functionally reliable in its operation and require, in particular, less space and/or be less voluminous.

It is within the scope of the present invention that, when in the transfer position of the feed apparatus, the grab is positioned and/or guided back into the first straight track sections in order to release a cardboard blank to the folder. When in the transfer position of the feeder the grab is advantageously positioned above the folding table of the folder, and the cardboard blank that has been picked up by the grab previously is released by the grab over the folding table and set thereon.

It has proven advantageous for the folder to comprise centering elements that can be used to center the cardboard blank that is placed on the folder and/or folding table. As outlined previously, a top view reveals this object preferably as a rectangular and/or square cardboard blank. It is recommended that each of the four side edges of such a cardboard blank comprise at least one centering element and/or is associated with a respective centering element. Advantageously, these centering elements are configured as vertically oriented centering plates that are movable to the center point of the cardboard blank and act upon the side edges during the centering process.

The folding action of the cardboard blank occurs, as is recommended, after completion of the preferably implemented centering process of the cardboard blank. To this end, the folder has at least one lift plunger; and the cardboard blank is pushed past folding elements and/or a stationary folding element of the folder while the lift plunger acts upon the floor panel of the cardboard blank so that the side panels of the cardboard blank are raised and/or folded up relative to the floor panel. It is advantageous for the at least one single lift plunger to be moved downward so that it may act upon the floor panel of the cardboard blank. As is recommended, the at least one lift plunger pushes the cardboard blank past the folding elements and/or stationary folding elements in such a way that the side panels of the cardboard blank are raised.

A preferred embodiment of the invention is characterized by the fact that the folder has a plurality of lift plungers, and these lift plungers are able to act upon the floor panel of the cardboard blank, and wherein the cardboard blank that is acted upon by the lift plungers and that is set on the folding table of the folder is guided together with the folding table past the folding elements and/or stationary folding elements, whereby the side panels are raised and/or folded upward. It is advantageous to provide at least four lift plungers that preferably act upon the corner regions of the floor panel of the cardboard box that is to be produced by the folding action. It is recommended for the lift plungers to move from top to bottom and then act upon the corner areas of the floor panel of the cardboard blank that is to become the cardboard box. It has been shown to be advantageous for the lift plungers to move the cardboard blank together with the folding table downward and alongside the folding elements and/or stationary folding elements, so as to raise the side panels of the cardboard blank. The scope of the invention envisions that the folding elements and/or stationary folding elements comprise vertical folding areas that effect the action of raising the side panels guided past them.

It is recommendable that the action of raising the side panels occurs with the provision that at least two side panels at respective opposite ends, have fastening tabs that project beyond the adjacent side panel, and wherein a fastening device is provided that attaches the fastening tabs to the outer faces of the respective adjacent side panels. It is recommended for two opposite side panels to have a fastening tab at both of their two ends that can be fastened to the assigned outer face of the adjacent side panel by the fastening device. According to the scope of the invention it is envisioned that the attached fastening tabs lie flatly against the outer faces of the respective adjacent side panels.

After the fastening tabs are fixed in place it is recommended that at least one lift plunger be moved upward once again and/or the lift plungers be move upward. Following the attachment process involving the fastening tabs, it is advantageous for the folding table, with the fully folded cardboard box thereon, to be moved back and/or upward into its starting position.

An especially preferred embodiment according to the invention provides that the grab of the feeder comprise at least one suction element, and that using this suction element it is possible to take up the cardboard blank—in particular from a cardboard blank supply—by taking advantage of a vacuum. Thus the cardboard blank is sucked upward by at least one suction element and thereby picked up by the grab. It is advantageous for the cardboard blank to be held in place by at least one suction element until it is released onto the folder and/or the folding table. The suction element is preferably configured in the shape of a suction cup. It is recommended that the grab comprise a plurality of suction cups for receiving a cardboard blank. A preferred embodiment according to the invention envisions at least four suction cups on the grab, and each of the four suction cups is assigned to a respective one of the corner areas of the cardboard blank and/or a corner area of the floor panel of the cardboard blank. Assignment to a corner area, as the term is used in the present context, means that during the pickup action of a cardboard blank each of the four suction cups acts upon one corner area of the cardboard blank and/or a corner area of the floor panel of the cardboard blank.

To attain the object of the present invention the invention further teaches a method of folding cardboard blanks into a cardboard box having a floor panel and four side panels. the method comprises the steps of:

holding a stack of the blanks in a supply station below a folding station;

engaging a grab downward with the blank uppermost in the stack and picking it up off the stack;

shifting the grab and the picked-up blank horizontally in one direction to a position offset from the stack and out from underneath the folding station;

shifting the grab and the picked-up blank vertically to a position above the folding station;

shifting the grab and the picked-up blank horizontally opposite to the one direction until the blank is above the folding station;

releasing the picked-up blank from the grab and thereby depositing the blank in the folding station;

folding the side panels relative to the floor panel of the deposited blank in the folding station and generally simultaneously shifting the grab vertically and horizontally back to a position above the stack; and repeating the first seven steps with the next blank uppermost in the stack.

The folding process of the cardboard box can be done during movement back to the starting position or after the movement to the pickup position has been completed.

A preferred embodiment of the method according to the invention provides that the feeder is moved vertically from the pickup position to the transfer position and vice versa, and the first and the second track sections, as well as the grab with the picked-up cardboard blank that is in the second track sections, are moved during this vertical movement along the folder and/or folding table.

The invention is based on the discovery that the cardboard-folding apparatus according to the invention can be operated at a higher operating speed in comparison to the prior art. In particular, speedy, functionally reliable feed action of cardboard blanks is possible, free of errors and damage. The cardboard blanks can be released with precision on the folder, and inside the folder the cardboard blank is folded into a cardboard box in a functionally reliable and flawless manner. In addition to the high operating speed, the cardboard-folding apparatus is also characterized by its relatively simple configuration of minimal complexity. The apparatus according to the invention can be implemented with relatively simple components and is therefore cheap to produce. To be noted especially is the fact that the apparatus according to the invention is characterized by its compactness and requires considerably less space than devices of the prior art.

BRIEF DESCRIPTION OF THE DRAWING

The above and other objects, features, and advantages will become more readily apparent from the following description, reference being made to the accompanying drawing in which.

DETAILED DESCRIPTION

Figure 1:
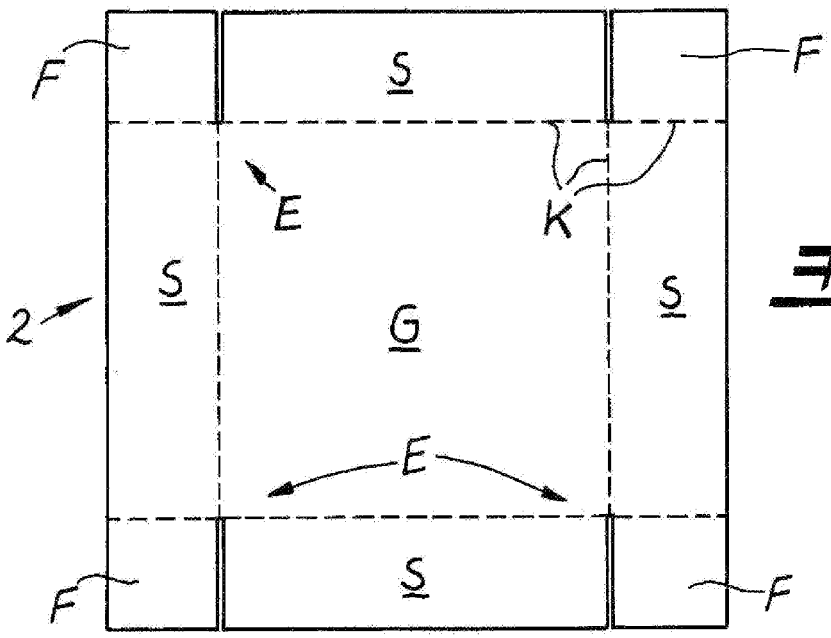
FIG. 1 is a plan view of a cardboard blank for a cardboard-folding apparatus according to the invention.
Figure 2:
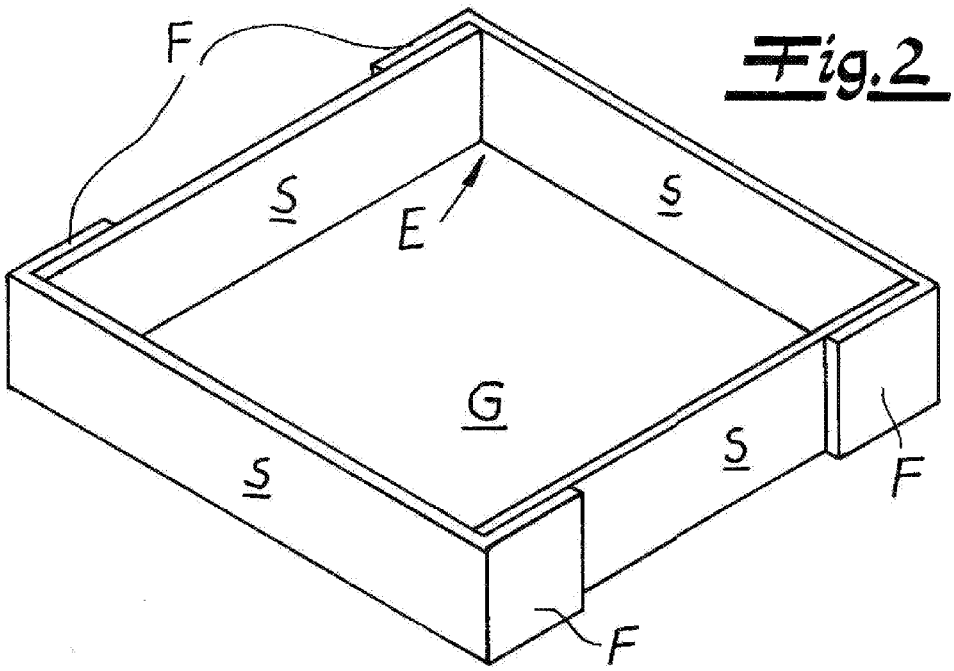
FIG. 2 is a perspective view of a finished cardboard box folded from the cardboard blank of FIG. 1.

As seen in FIG. 1 a cardboard box (FIG. 2) is made from a blank 2 having a floor panel G and four side panels S. In this cardboard blank 2 (FIG. 1) the floor panel G is in the same plane with the four side panels S. Also envisioned are fold lines K that are weak spots in the material. In the instance of the cardboard-folding apparatus according to the invention, the side panels S are raised and/or folded upward relative to the floor panel G, and then the side panels S are oriented to extend perpendicular to the floor panel G. Two of the side panels S are provided at both of their ends with fastening tabs F that can be folded over by 90° and attached to the outer faces of the respective adjacent side panels S. FIG. 2 shows a completed cardboard box produced by the cardboard-folding apparatus according to the invention. The cardboard box is advantageously square and open upwardly.

FIGS. 3 to 7 illustrate the cardboard-folding apparatus according to the invention. This apparatus has a frame 15 carrying a feeder 1 for supplying the cardboard blanks 2 as well as a folder 3 for folding the cardboard blanks 2. FIGS. 3 to 6 demonstrate how a cardboard blank supply provided below the folder 3 holds a stack 4 formed by multiplicity of the cardboard blanks 2. The feeder 1 has a guide 5 having two tracks 6 that are parallel to each other. The guide 5 and/or tracks 6 hold a grab 7 for picking up, transporting, and releasing a cardboard blank 2. This grab 7 is movable in the tracks 5 and will be explained in further detail below. The track guide 5 has two straight upstream track sections 8 as well as two downstream track sections 9 shaped as a circular arc, giving each track 5 the shape of a recumbent J. Control means 16 is connected to the folder 3, feeder 1, and grab 7 to operate them as described below.

Figure 3:
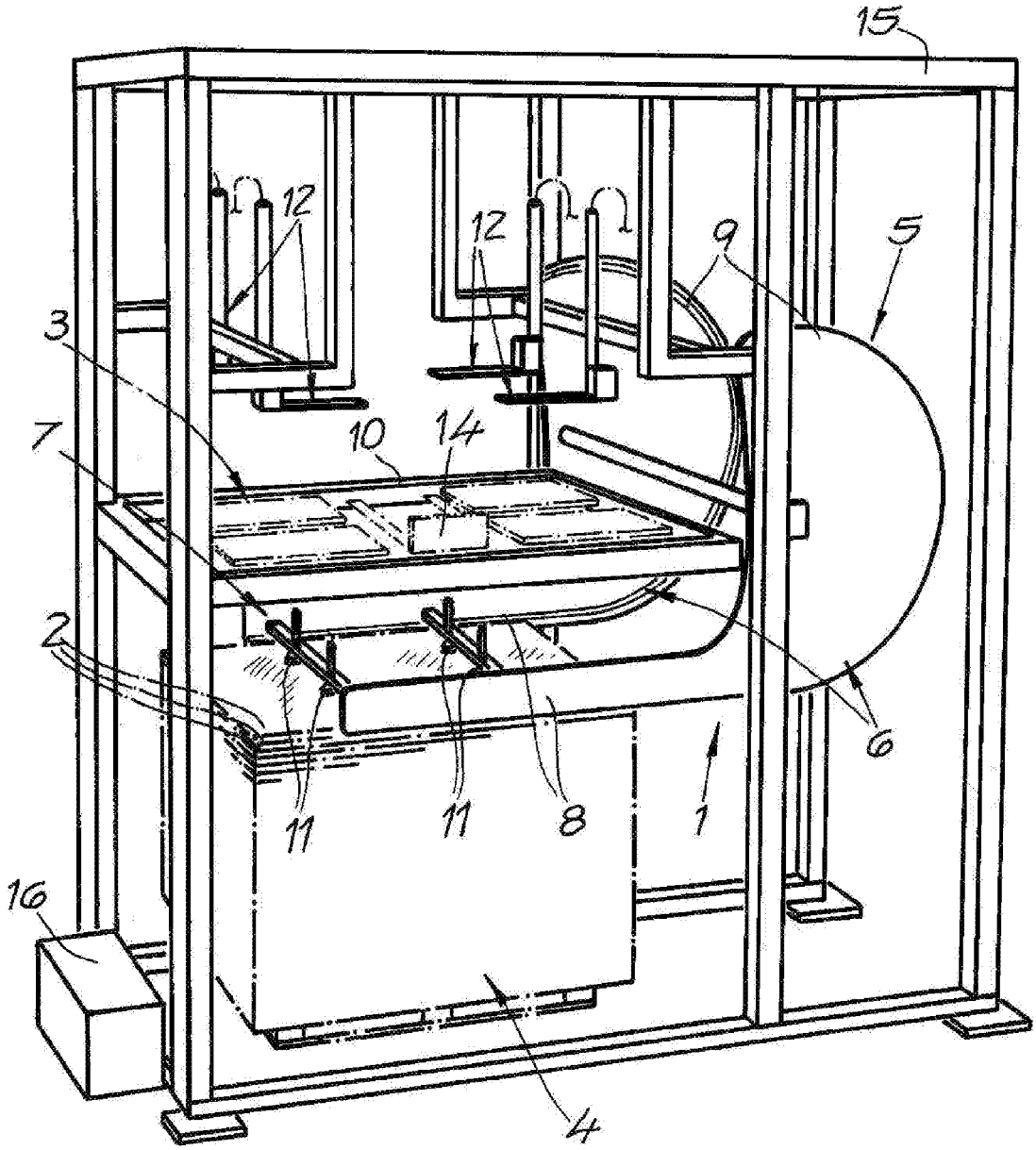
FIG. 3 is a perspective view of the cardboard-folding apparatus according to the invention in a first position.

FIG. 3 shows a first position of the folding apparatus according to the invention in which the feeder 1 and/or the track guide 5 is in a lower starting or pickup position. Here, the straight track sections 8 are below a folding table 10 of the folder 3. The grab 7 is positioned in the first straight track sections 8 in the pickup position of the feeder 1. In this position the grab 7 picks up the uppermost cardboard blank 2 from the stack 4 of cardboard blanks. As explained in further detail below, the grab 7 has suction cups 11 for this purpose that lift and hold the cardboard blank 2.

Figure 4:
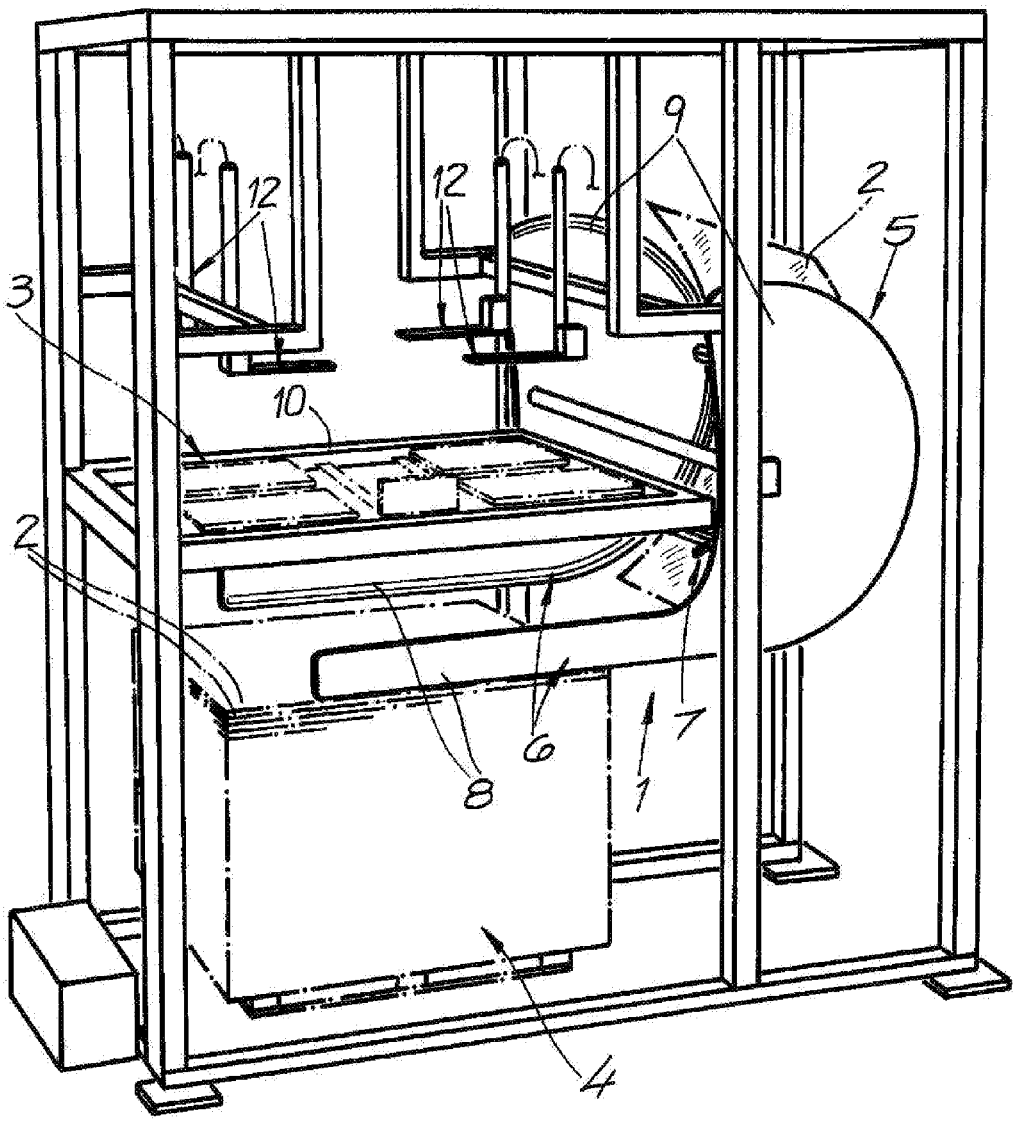
FIGS. 4, 5, and 6 are views like FIG. 3 in successive operational positions of the apparatus.
Figure 5:
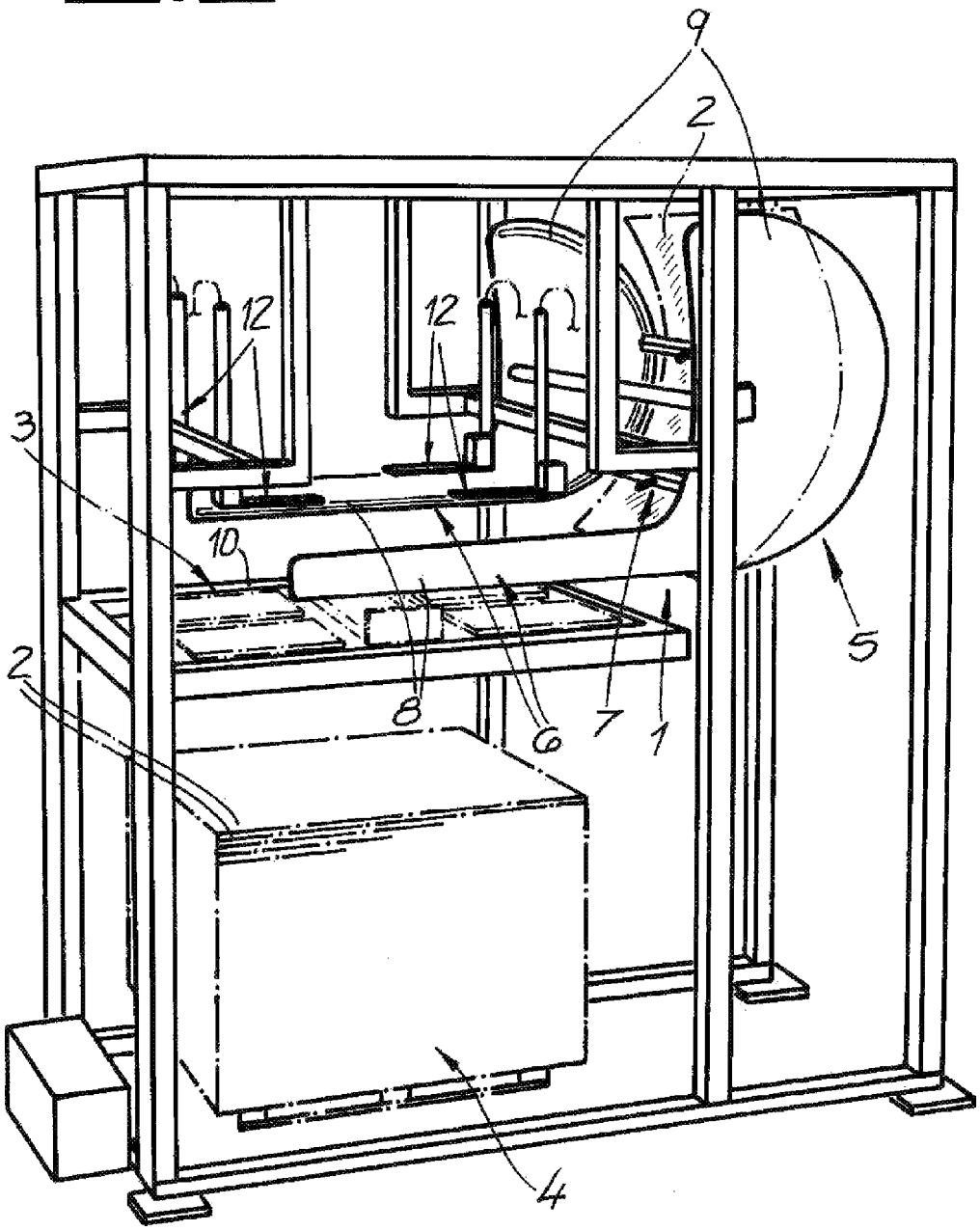
Figure 6:
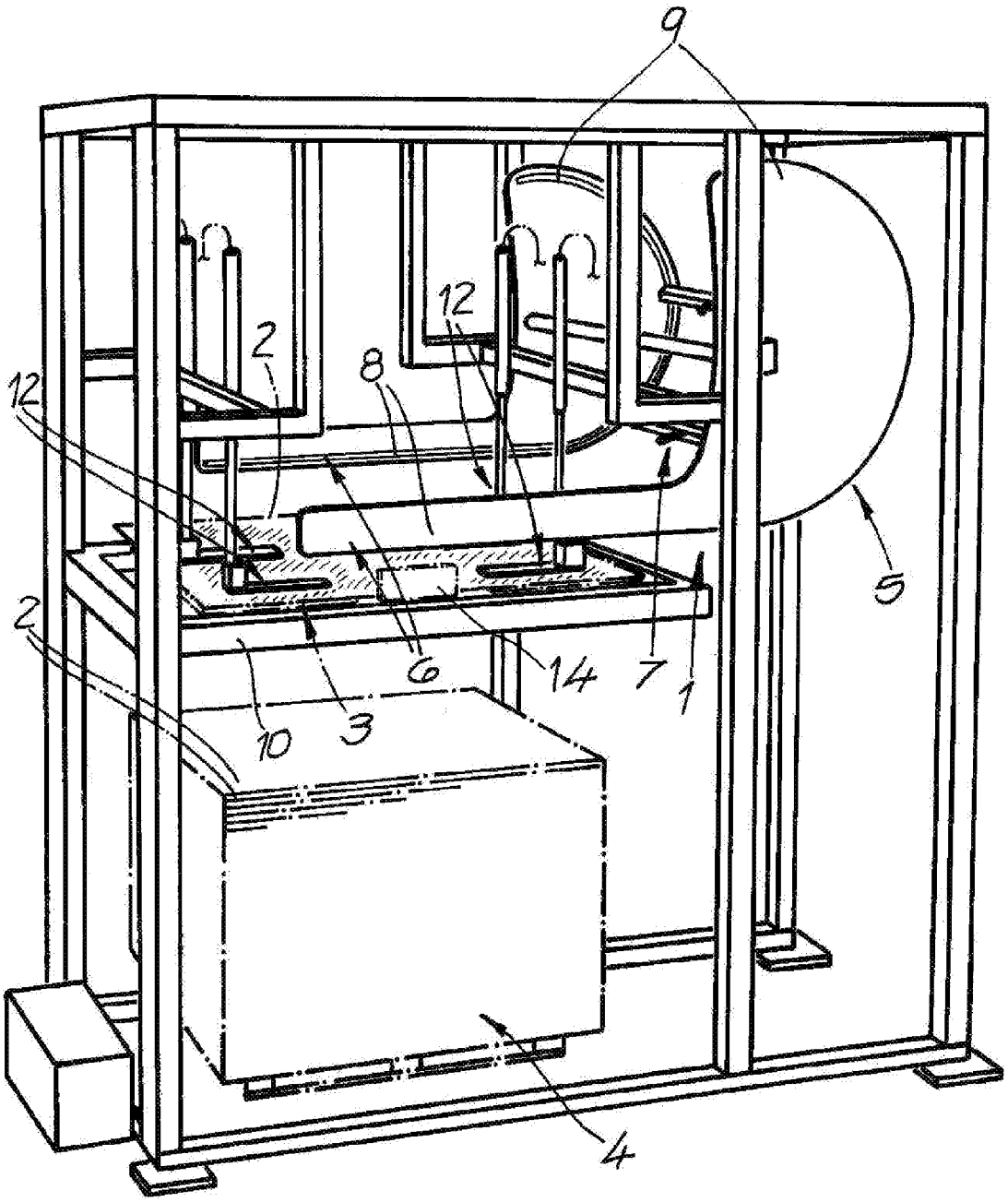

After having picked up a cardboard blank 2, the grab 7 is moved together with the picked-up cardboard blank 2 inside the track guide 5 to the second circularly arcuate track sections 9 as shown in FIG. 4. Subsequently, the feeder 1 and/or the track guide 5 with the grab 7 is moved vertically and upward from the pickup position (FIGS. 3 and 4) to a transfer position (FIGS. 5 and 6). The straight track sections 8, the circularly arcuate track sections 9 and the grab 7 are moved vertically relative to the folding table 10 during this step. The sheet blank 2 during this vertical movement is bent into an arcuate shape and extends mainly vertical so that it can pass the folder table 10.

FIG. 5 shows the feeder 1 and/or track guide 5 in the transfer position. Here, the grab 7, together with the picked-up cardboard blank 2, is still being held in the circularly arcuate track section 9. The grab 7 together with the picked-up cardboard blank 2 is then moved in the track guide 5 to the straight track sections 8. Then, the grab 7 releases the cardboard blank 2 and deposits it on the folding table 10, thereby allowing the position according to FIG. 6 to be reached. The feeder 1 and/or track guide 5 is then advantageously moved vertically downward from the transfer position back to the pickup position.

The folder 3 advantageously has elements 14 that center the cardboard blank 2 on the folding table 10. According to the invention, following the centering step, four plungers 12 are moved downward against the four corners E of the floor panel G of the cardboard blank 2 lying on the folding table 10. The plungers 12 then press the folding table 10 and the cardboard blank 2 on it downward, past the stationary folding elements 14 so that the side panels S of the cardboard blank 2 are raised and/or folded upward. Afterward the two fastening tabs F of two opposite walls S that project from their ends are advantageously secured to the outer faces of the respective adjacent side panels.

Figure 7:
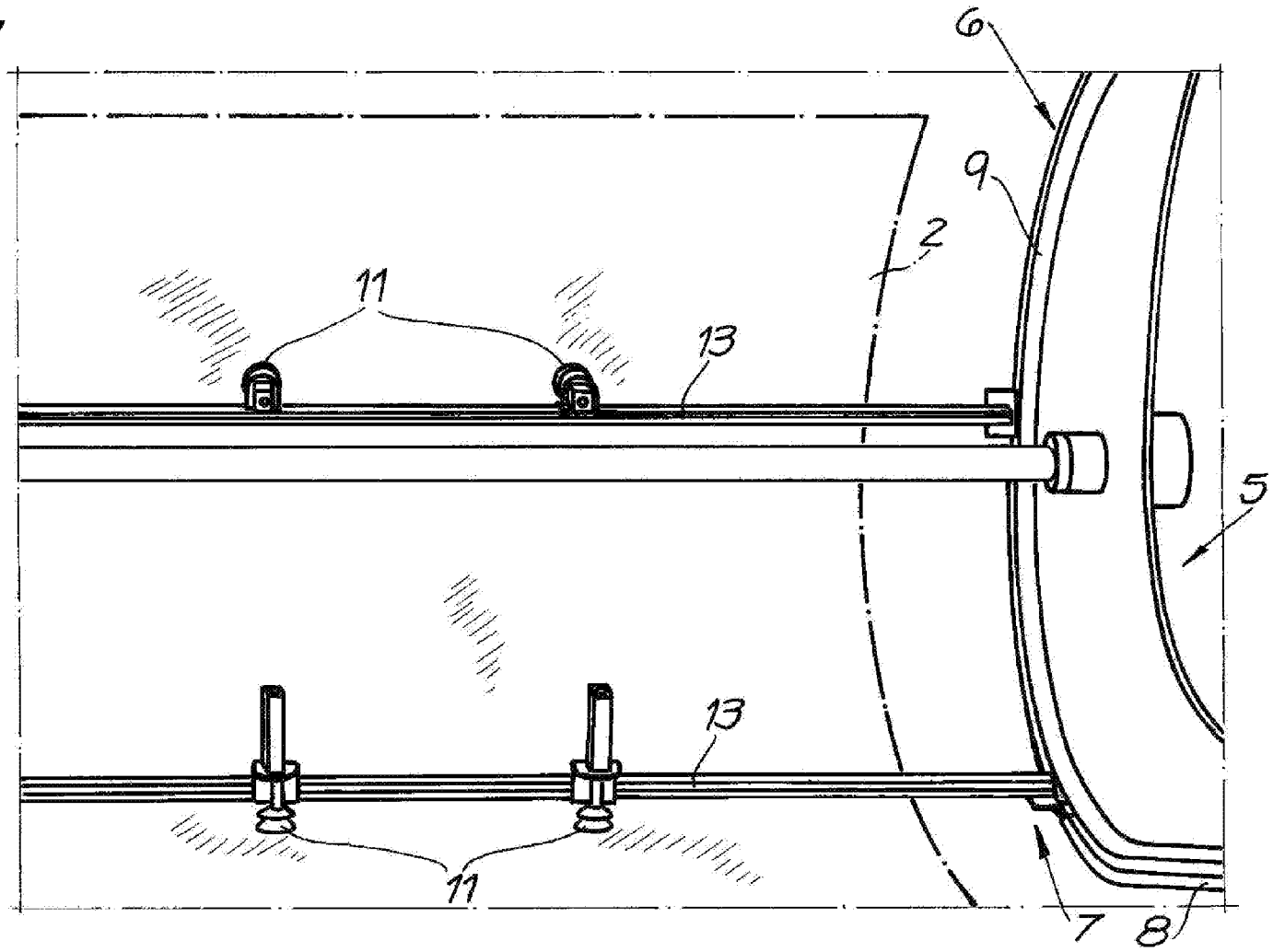
FIG. 7 is a large-scale perspective view of a detail of the apparatus.

FIG. 7 shows the grab 7 of the feeder 1. In this embodiment the grab 7 preferably has two bars 13 pivotally coupled to each other. Each of these bars 13 carries two of the suction cups 11. The suction cups 11 engage in the four corners of this cardboard blank 2 in order to effect the actual pickup of the cardboard blank. A vacuum acts on the suction cups 11 so that there is a suction effect created between the cardboard blank 2 and the suctions cups 11.

The folding apparatus 3 is furthermore fully closed downward toward the blank stack 4 in a manner not further described in the present context. This way, it is possible to prevent, for example, glue residue, etc. from getting on the cardboard blanks 2 of the stack 4. The cardboard-folding apparatus is thus also characterized by clean operation.

I claim:

1. An apparatus for making a box from a blank that is foldable and has a central polygonal floor panel and a plurality of outwardly projecting side panels, the apparatus comprising:

a frame;

a supply on the frame holding the blank;

a folder on the frame directly above the supply;

a guide having a first horizontal straight guide section shiftable between a lower pick-up position immediately above the supply and an upper transfer position immediately above the folder, the guide further having a second generally vertical guide section connected to the first guide section and horizontally offset from the folder;

a grab movable along the first and second guide sections, engageable in the lower pick-up position of the guide and when in the first guide section with the blank in the supply to pick up the blank and movable with the blank into the second guide section such that the picked-up blank is horizontally offset from the folder and moves past the folder during movement of the guide from the lower position into the upper position, and movable in the upper position of the guide with the picked-up blank to a position with the picked-up blank above the folder; and control means connected to the guide, to the grab, and to the folder for sequentially picking up the blank in the supply with the grab when the guide is in the lower position and the grab is in the first guide section, moving the picked-up blank and the grab into the second guide section, moving the guide into the upper position such that first guide section is above the folder, moving the grab with the picked-up blank back into the first guide section, releasing the picked-up blank from the guide and thereby depositing the picked-up blank in the folder, and folding the blank with the folder into a box.

2. The box-making apparatus defined in claim 1 wherein the supply holds a stack of the blanks of which one is an uppermost blank and with each cycle of the apparatus the uppermost blank on the stack is moved from the stack to the folder.

3. The box-making apparatus defined in claim 1 wherein the second guide section is arcuate.

4. The box-making apparatus defined in claim 3 wherein the grab has at least one suction element.

5. The box-making apparatus defined in claim 3 wherein there are two of the guides horizontally flanking the folder, each having one of the first guide sections and one of the second guide sections, and vertically shiftable past the folder when the grab is in the second guide sections.

6. The box-making apparatus defined in claim 2 wherein the folder includes relatively stationary elements on which the side panels of the blank are set when the blank is deposited in the folder and at least one plunger engageable with the floor panel of the deposited blank for pressing the deposited blank past the stationary folding elements and folding up the side panels to form a box.

7. The apparatus defined in claim 1, wherein the second guide section is oriented such that when the grab is engaged in the second guide section the blank picked up by the grab is oriented at least generally vertical, and the first guide section is oriented such that when the grab is engaged in the first guide section the blank picked up by the grab is oriented horizontal.

8. The apparatus defined in claim 7, wherein the second guide section is oriented such that when the grab is engaged in it the blank picked up by the grab is bent at least partially into an arcuate shape.

9. The apparatus defined in claim 7, wherein the blank is substantially flat and horizontal when in the first guide section and directly above or below the folder.

* * * * *